US010151485B2

(12) United States Patent
Lunel et al.

(10) Patent No.: US 10,151,485 B2
(45) Date of Patent: Dec. 11, 2018

(54) ANNULAR COMBUSTION CHAMBER

(71) Applicant: SNECMA, Paris (FR)

(72) Inventors: Romain Nicolas Lunel, Montereau sur le Jard (FR); Denis Jean Maurice Sandelis, Nangis (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 276 days.

(21) Appl. No.: 14/708,699

(22) Filed: May 11, 2015

(65) Prior Publication Data

US 2016/0084501 A1 Mar. 24, 2016

(30) Foreign Application Priority Data

May 12, 2014 (FR) ..... 14 54216

(51) Int. Cl.
*F23R 3/00* (2006.01)
*F23R 3/50* (2006.01)
(Continued)

(52) U.S. Cl.
CPC ..... *F23R 3/002* (2013.01); *F01D 25/243* (2013.01); *F01D 25/265* (2013.01); *F01D 25/28* (2013.01);
(Continued)

(58) Field of Classification Search
CPC ..... F23R 3/44; F23R 3/50; F23R 3/60; F01D 25/243; F01D 25/28
See application file for complete search history.

(56) References Cited

U.S. PATENT DOCUMENTS 4,686,823 A * 8/1987 Coburn ..... F23R 3/10 60/740
5,353,587 A 10/1994 Halila
(Continued)

FOREIGN PATENT DOCUMENTS

EP 0 584 906 A2 3/1994
EP 0584906 A2 * 3/1994 ..... F23R 3/002
(Continued)

OTHER PUBLICATIONS

U.S. Appl. No. 12/989,292, filed Feb. 9, 2011, 2011-0120144, Berdou, et al.
(Continued)

*Primary Examiner* — Ehud Gartenberg
*Assistant Examiner* — Stephanie Cheng
(74) *Attorney, Agent, or Firm* — Oblon, McClelland, Maier & Neustadt, L.L.P.

(57) ABSTRACT

A turbine engine having an annular combustion chamber formed by two coaxial annular shrouds, an inner shroud and an outer shroud relative to the axis of the turbine engine, which shrouds are arranged one inside the other and are connected together at their upstream ends by an annular chamber end wall that is fastened to an outer casing surrounding the outer annular shroud, the downstream ends of the inner and outer annular shrouds being connected to flanges fastened to an inner casing and to the outer casing, respectively. The upstream end of at least one of the inner and outer shrouds is centered by bearing radially against the annular chamber end wall and co-operates therewith in leaktight axial sliding.

6 Claims, 2 Drawing Sheets

(51) Int. Cl.

| | |
|---|---|
| ***F23R 3/60*** | (2006.01) |
| ***F01D 25/24*** | (2006.01) |
| ***F01D 25/26*** | (2006.01) |
| ***F01D 25/28*** | (2006.01) |
| ***F23R 3/44*** | (2006.01) |

(52) U.S. Cl.
CPC ..... *F23R 3/44* (2013.01); *F23R 3/50* (2013.01); *F23R 3/60* (2013.01); *F23R 2900/00005* (2013.01)

(56) References Cited

U.S. PATENT DOCUMENTS

| | | | | |
|---|---|---|---|---|
| 5,479,772 | A | 1/1996 | Halila | |
| 5,524,430 | A * | 6/1996 | Mazeaud | F23R 3/283 60/752 |
| 5,916,142 | A * | 6/1999 | Snyder | F23C 7/004 60/740 |
| 7,637,110 | B2 * | 12/2009 | Czachor | F01D 25/28 415/136 |
| 7,661,273 | B2 * | 2/2010 | Commaret | F02C 3/14 415/209.2 |
| 8,839,627 | B2 * | 9/2014 | Eastwood | F23R 3/002 60/752 |
| 9,046,272 | B2 * | 6/2015 | Rice | F23R 3/60 |
| 2007/0180809 | A1 * | 8/2007 | Bessagnet | F23R 3/10 60/39.01 |
| 2011/0056207 | A1 * | 3/2011 | Commaret | F02C 3/08 60/751 |
| 2011/0120144 | A1 | 5/2011 | Berdou et al. | |
| 2012/0073259 | A1 | 3/2012 | Hernandez et al. | |
| 2013/0081270 | A1 * | 4/2013 | Patterson | F23R 3/002 29/888 |
| 2013/0192262 | A1 * | 8/2013 | Eastwood | F23R 3/002 60/805 |
| 2015/0354820 | A1 * | 12/2015 | Vetters | F23R 3/44 60/796 |
| 2017/0058778 | A1 * | 3/2017 | Bloom | F23R 3/007 |

FOREIGN PATENT DOCUMENTS

| | | | | |
|---|---|---|---|---|
| FR | 2 686 683 | A1 | 7/1993 | |
| GB | 1 219 665 | | 1/1971 | |
| GB | 2 011 546 | A | 7/1979 | |
| GB | 2011546 | A * | 7/1979 | F23R 3/50 |
| GB | 2 135 440 | A | 8/1984 | |

OTHER PUBLICATIONS

U.S. Appl. No. 13/259,941, filed Sep. 23, 2011, 2012-0073259, Hernandez, et al.

French Preliminary Search Report dated Jan. 9, 2015 in French Application 14 54216, filed on May 12, 2014 ( with English Translation of Categories of Cited Documents).

* cited by examiner

ANNULAR COMBUSTION CHAMBER

BACKGROUND OF THE INVENTION

Field of the Invention

The present invention relates to a turbine engine having an annular combustion chamber, which turbine engine may be an airplane turboprop or turbojet.

DESCRIPTION OF THE RELATED ART

FIG. 1 shows a prior art annular combustion chamber. This combustion chamber 10, of axis 11, has two coaxial annular shrouds, an inner shroud 12 and an outer shroud 14 that are fastened by bolts 16 at their upstream ends to an annular chamber end wall 18 that is very rigid. It also has an upstream annular fairing 20 fastened by the bolts 16 to the chamber end wall 18 and serving to direct the air stream both to enter and to bypass the combustion chamber 10. The chamber end wall 18 and the fairing 20 have openings 22, 24 allowing air to enter into the chamber and enabling injector heads 26 to be inserted for injecting fuel in the combustion chamber 10.

The downstream end of the inner annular shroud 12 is connected to an annular flange 26 for fastening to an inner casing 28 arranged radially inside the inner annular shroud 26 relative to the axis 30 of the turbine engine. At its radially inner end, the inner annular flange 26 has a radial annular wall 32 fastened by bolts to a corresponding radial annular wall 34 of the inner casing 28. Likewise, the downstream end of the outer annular shroud 14 is connected to an annular flange 36 for fastening to an outer casing 38 surrounding the combustion chamber 10. The radially outer end of the outer flange 36 has a radial annular wall 40 fastened by bolts to a corresponding radial annular wall 42 of the outer casing 38.

As shown in FIG. 1, the outer casing 38 also has a plurality of projections 44 circumferentially distributed around the axis of the turbine engine, each enabling a fuel injector 26 to be fastened with an arm 46 passing through the projection 44, the downstream end of the injector, or injector "head" 48, being received in an opening 22 in the fairing 20 that axially faces an opening 24 in the chamber end wall 18, and serving to inject fuel into the combustion chamber 10. In order to ignite the injected fuel, one or more spark plugs 50 are carried by the outer casing 38 and pass through both the outer casing and the outer annular shroud 14 so that the radially inner end(s) of the spark plug(s) 50 is/are flush with the inside face of the outer shroud 14.

Such a combustion chamber is presently in widespread use since it makes it possible to have good axial alignment of the outlet from the chamber 10 relative to the nozzle of the high-pressure turbine (not shown) arranged at the outlet from the combustion chamber 10. In this way, it is possible to limit leakage of hot gas leaving the combustion chamber.

Nevertheless, the lack of fastening at the upstream end of the chamber 10 leads to it being cantilevered out, and because of the considerable levels of vibration and temperature in the chamber in operation, that can result in the inner and outer annular shrouds 12 and 14 deforming non-elastically (plastically), which can generate large numbers of crack starters. Cracks forming in the inner and outer annular shrouds 12 and 14 can propagate quickly because of the presence of the perforations they include, in particular for bringing in dilution air. Furthermore, it is difficult to position the heads 48 of the injectors 26 relative to the openings in the chamber end wall 18 because of the above-mentioned deformation in operation and because of the cantilevered-out mounting.

Thus, in Document FR 2 686 683 in the name of the Applicant, proposals are made to fasten the chamber end wall to the outer casing by means of threaded rods passing through the casing, the upstream ends of the inner and outer annular shrouds being fastened to the chamber end wall, and the downstream ends being fastened by bolts to inner and outer casings. Although that mounting provides good relative positioning for the injectors, it nevertheless leads to the mounting of the combustion chamber being statically undetermined, which is undesirable since that leads to an increase in stresses on the inner and outer annular shrouds.

Furthermore, replacing the downstream fastenings of the inner and outer annular shrouds by having them merely bearing against the inner and outer casings, respectively, is undesirable since that no longer makes it possible to guarantee that the outlet from the chamber is properly positioned axially relative to the nozzle of the high-pressure turbine, and can lead to increased leakage of hot gas.

BRIEF SUMMARY OF THE INVENTION

A particular object of the present invention is to provide a solution that is simple, inexpensive, and effective to these problems, making it possible to avoid the above-specified drawbacks, at least in part.

For this purpose, the invention proposes a turbine engine having an annular combustion chamber formed by two coaxial annular shrouds, an inner shroud and an outer shroud relative to the axis of the turbine engine, which shrouds walls are arranged one inside the other and are connected together at their upstream ends by an annular chamber end wall that is fastened to an outer casing surrounding the outer annular shroud, the downstream ends of the inner and outer annular shrouds being connected to flanges fastened to an inner casing and to the outer casing, respectively, the turbine engine being characterized in that the upstream end of at least one of the inner and outer shrouds is centered by bearing radially against the annular chamber end wall and co-operates therewith in leaktight axial sliding.

According to the invention, both the upstream end of the chamber and the downstream end of the chamber are thus fastened to the inner and outer casings of the chamber, thereby enabling the injector heads to be positioned easily relative to the openings in the chamber end wall and enabling the outlet from the chamber to be properly positioned relative to a high-pressure nozzle of a high-pressure turbine arranged immediately downstream from the combustion chamber. Adding a sliding connection between the chamber end wall and at least one of the upstream ends of the inner and outer annular shrouds serves to channel deformation in the elongation direction.

According to another characteristic of the invention, the upstream end of the inner shroud and the upstream end of the outer annular shroud are centered on the annular chamber end wall, each of them co-operating therewith in leaktight axial sliding.

Preferably, the annular chamber end wall has two annular rims, an inner rim and an outer rim that extend substantially axially, the upstream end of the outer shroud being centered on the outer annular rim by bearing radially inwards against the outer annular rim, the upstream end of the inner shroud being centered on the inner annular rim by bearing radially outwards against the inner annular rim.

The outer casing may have orifices for passing rods for fastening to the outer annular rim of the chamber end wall.

The combustion chamber may also have a fairing extending upstream from the chamber end wall and including inner and outer annular rims fastened by members for bolting to the inner and outer annular rims respectively of the annular chamber end wall.

Preferably, the upstream edges of each of the inner and outer annular shrouds include notches passing both said rods for fastening to the outer annular rim of the chamber end wall and also said members for bolting the fairing to the chamber end wall.

In a practical embodiment of the invention, it includes at least four rods regularly distributed around the axis of the combustion chamber.

BRIEF DESCRIPTION OF THE SEVERAL VIEWS OF THE DRAWINGS

The invention can be better understood and other characteristics, advantages, and characteristics of the invention appear on reading the following description made by way of nonlimiting example and with reference to the accompanying drawings, in which.

DETAILED DESCRIPTION OF THE INVENTION

Figure 1:
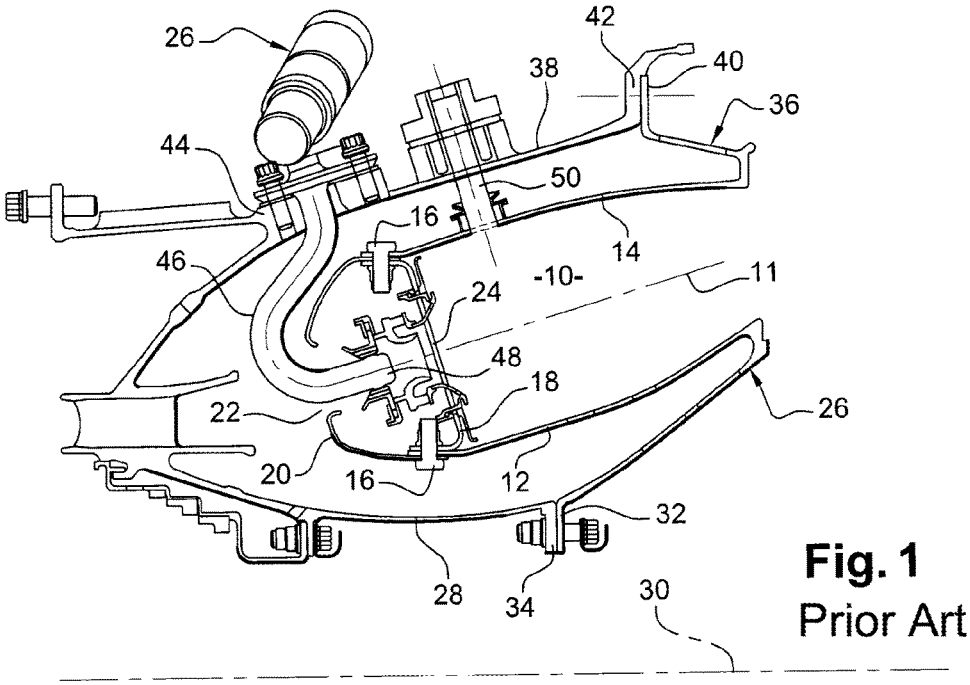
Fig. 1 Prior Art
FIG. 1 is a diagrammatic axial section view of a combustion chamber of the prior art as described above.
Figure 2:
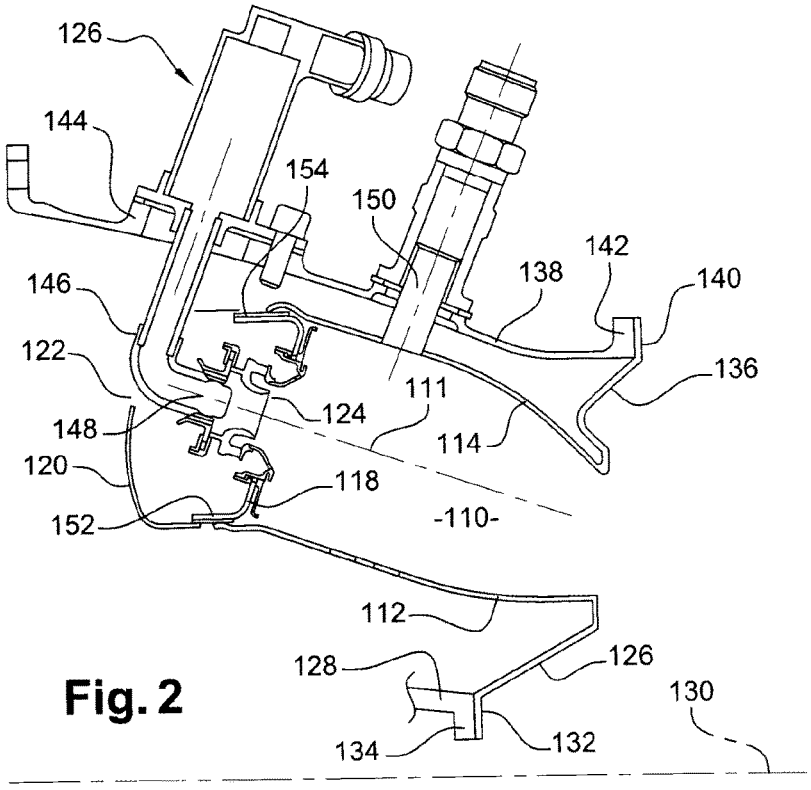
FIG. 2 is a diagrammatic axial section view of a combustion chamber of the invention.

Reference is made to FIG. 2, which shows a combustion chamber 110 of the invention. In the embodiment shown, the combustion chamber is of the converging type, i.e. its hot gas ejection axis 111 converges downstream towards the axis 130 of the turbine engine. The description made with reference to FIG. 1, which shows a diverging combustion chamber, is applicable to FIG. 2. The references for elements that are similar are incremented by one hundred and they are not necessarily described again.

The downstream end of the inner annular shroud 112 is connected to an inner annular flange 126 including an internal radial annular wall 132 that is fastened by bolts to a corresponding radial annular wall 134 of an inner casing 128. Likewise, the downstream end of the outer annular shroud 114 is connected to an outer annular flange 136 including an external radial annular wall 140 fastened by bolts to a radial annular wall 142 at the downstream end of the outer casing 138 surrounding the combustion chamber 110.

As shown in FIG. 2, the chamber end wall 118 has two coaxial annular rims, an inner rim 152 and an outer rim 154 that extend substantially axially. According to the invention, the upstream end of the outer annular shroud 114 is centered on the outer annular rim 154 by bearing radially inwards thereon. Likewise, the upstream end of the inner annular shroud 112 is centered on the inner annular rim 152 by bearing radially outwards thereon.

The mounting of the invention permits leaktight relative axial sliding between the upstream ends of the inner and outer annular shrouds 112 and 114 and the inner and outer annular rims 152 and 154 respectively of the annular chamber end wall 118.

Figure 3:
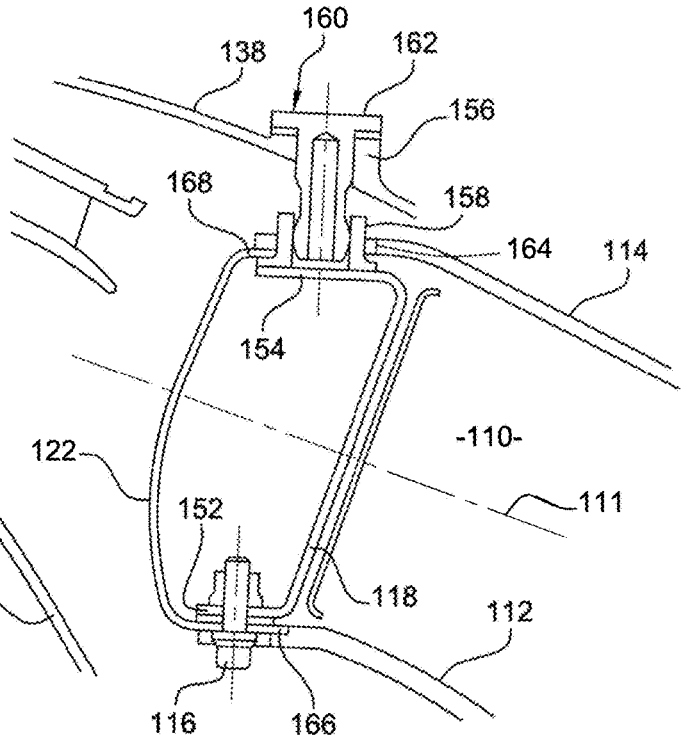
FIG. 3 is a diagrammatic section view of the upstream end of the FIG. 2 combustion chamber on an axial section plane containing the members for fastening the upstream end of the combustion chamber.
Figure 4:
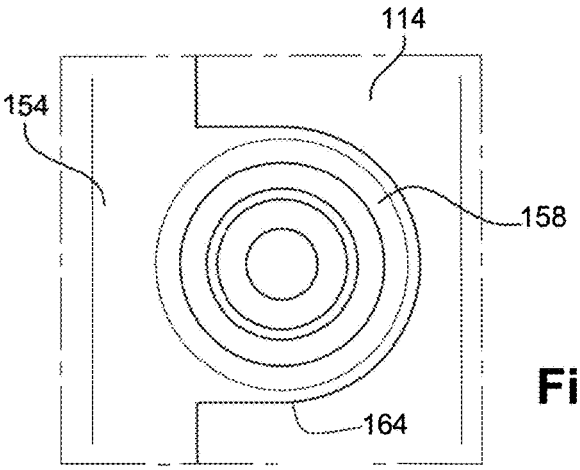
FIG. 4 is a diagrammatic plan view of cooperation between the outer annular shroud and the annular chamber end wall.

In order to fasten to the upstream end of the combustion chamber, the outer casing 138 has projections 156 regularly distributed over the outside face of the outer casing 138, as shown in FIG. 3. Each of these projections 156 has an orifice of axis that is radially in alignment with the axis of an opening in a tubular projection 158 formed on the outer face of the outer annular rim 154 of the annular chamber end wall 118. A fastener rod 160 is engaged from the outside of the outer casing 138 in each opening of a projection 156 of the outer casing 138 and has a radially inner end screwed into a complementary thread of the inside surface of the corresponding tubular projection 158. Externally, the rod 160 has a flat head 162 that comes into abutment against the projection 156 of the outer casing 138 during screw tightening.

Figure 5:
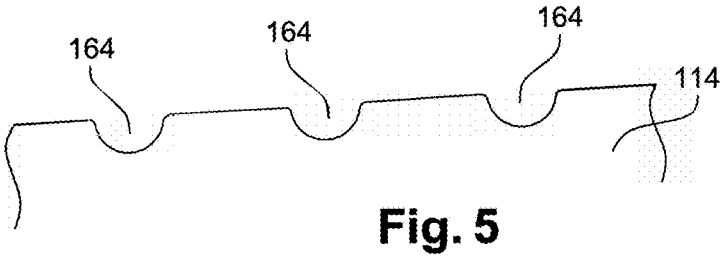
FIG. 5 is a diagrammatic developed view of the upstream end of the outer annular shroud.

As also shown in FIG. 5, the upstream edge of the outer annular shroud 114 includes notches 164 (setbacks or hollow portions) that receive the tubular projections 158 of the outer annular rim 154 of the chamber end wall 118. Thus, the outer annular shroud 114 may be in radial contact with the outer annular rim 154 of the chamber end wall over an axial distance that is sufficient to ensure that leaktight sliding does indeed occur, and with this applying regardless of any axial movements of the parts relative to one another.

The inner annular shroud 112 may also include notches receiving the bolts 116 fastening the inner annular rim 152 of the chamber end wall to the inner annular rim 166 of the fairing 122.

Likewise, the outer annular shroud 114 may also include notches 164 receiving the bolts 116 fastening the outer annular rim 154 of the chamber end wall to the outer annular rim 168 of the fairing 122. Under such circumstances, the bolts 116 of the outer annular rim 154 of the chamber end wall 118 and the fastener rods 160 form an annular row, and compared with the inner annular shroud 112, the outer annular shroud 114 has as many additional notches 164 as there are tubular projections 158 for fastening fastener rods 160.

The invention claimed is:

1. A turbine engine comprising:

an annular combustion chamber formed by two coaxial annular shrouds including an inner annular shroud and an outer annular shroud relative to an engine axis of the turbine engine, the inner annular shroud is arranged inside the outer annular shroud and the two coaxial annular shrouds are connected together at upstream ends thereof by an annular chamber end wall that is fastened to an outer casing surrounding the outer annular shroud, downstream ends of the inner and outer annular shrouds are connected to first and second flanges fastened to an inner casing and to the outer casing, respectively, wherein the upstream end of the inner annular shroud and the upstream end of the outer annular shroud are centered by bearing radially against the annular chamber end wall, each of the upstream ends of the inner annular shroud and of the outer annular shroud co-operating therewith in leaktight axial sliding, wherein the annular chamber end wall includes two annular rims consisting of an inner annular end wall rim and an outer annular end wall rim that extend substantially axially, the upstream end of the outer annular shroud being centered on the outer annular end wall rim by bearing radially inwards against the outer annular end wall rim, the upstream end of the inner annular shroud being centered on the inner annular end wall rim by bearing radially outwards against the inner annular end wall rim, wherein the annular combustion chamber includes a fairing extending upstream from the annular chamber end wall and including inner and outer annular fairing rims fastened by members for bolting to the inner and outer annular end wall rims, respectively, wherein the inner annular fairing rim is disposed radially between the inner annular end wall rim and the upstream end of the inner annular shroud, and the outer annular fairing rim abuts the outer annular shroud and is disposed radially between the outer annular end wall rim and the upstream end of the outer annular shroud, wherein the outer casing includes at least one projection with an orifice having an orifice axis which is radially in alignment with an opening axis of an opening in at least one tubular projection formed on an outer face of the outer annular end wall rim of the annular chamber end wall, wherein a fastener rod passes through the orifice of the at least one projection of the outer casing and includes a radially inner end which engages the opening in the at least one tubular projection, and wherein the upstream end of the outer annular shroud includes at least one first notch which receives the at least one tubular projection and the fastener rod.

2. The turbine engine according to claim 1, wherein the upstream end of the inner annular shroud includes at least one second notch passing at least one of said members for bolting the fairing to the annular chamber end wall.

3. The turbine engine according to claim 1, comprising at least four fastener rods regularly distributed around the engine axis of the turbine engine.

4. The turbine engine according to claim 1, wherein a first radial wall of the inner casing to which the first flange of the inner annular shroud is fastened is further upstream than a second radial wall of the outer casing to which the second flange of the outer annular shroud is fastened.

5. The turbine engine according to claim 1, wherein the inner annular end wall rim and the outer annular end wall rim each extend substantially axially upstream such that free ends of the inner annular end wall rim and the outer annular end wall rim are upstream of the inner annular shroud and the outer annular shroud.

6. The turbine engine according to claim 1, wherein a downstream end of the inner annular fairing rim abuts the inner annular shroud.

* * * * *